US005719390A

United States Patent [19]

Tateishi et al.

[11] Patent Number: 5,719,390

[45] Date of Patent: Feb. 17, 1998

[54] PHOTODETECTION TUBE WITH A LID AND CATHODE HOLDING MEMBER IN THERMAL CONTACT WITH A COOLER

[75] Inventors: Naohisa Tateishi; Hisaki Kato; Katurou Hikita, all of Hamamatsu, Japan

[73] Assignee: Hamamatsu Photonics K.K., Hamamatsu, Japan

[21] Appl. No.: 496,647

[22] Filed: Jun. 29, 1995

[30] Foreign Application Priority Data

Jun. 29, 1994 [JP] Japan ..... 6-148200

[51] Int. Cl.[6] ..... H01J 40/14

[52] U.S. Cl. ..... 250/207; 250/214 VT; 257/718; 313/544

[58] Field of Search ..... 250/207, 214 VT, 250/214 R, 239; 257/707, 718; 313/39, 11, 542–544, 103 CM, 105 CM, 532–536

[56] References Cited

U.S. PATENT DOCUMENTS

| | | | |
|---|---|---|---|
| 3,757,151 | 9/1973 | Ace | 313/39 |
| 3,814,964 | 6/1974 | Ace | 313/39 |
| 5,343,360 | 8/1994 | Sanwo | 257/707 |
| 5,446,275 | 8/1995 | Sakai et al. | 250/207 |

FOREIGN PATENT DOCUMENTS 0584016 11/1993 Japan .

*Primary Examiner*—Que Le
*Attorney, Agent, or Firm*—Cushman Darby & Cushman IP Group of Pillsbury Madison & Sutro LLP

[57] ABSTRACT

A photomultiplier includes a cathode supporting member, arranged in a tube and comprised of a conductive material, for holding a photocathode, and a holding mechanism, comprised of a heat conductive material, for biasing the cathode holding member to hold it. The holding mechanism is thermally connected to a cooler.

2 Claims, 14 Drawing Sheets

PHOTODETECTION TUBE WITH A LID AND CATHODE HOLDING MEMBER IN THERMAL CONTACT WITH A COOLER

BACKGROUND OF THE INVENTION

1. Field of the Invention

The present invention relates to a side-on reflection type photoelectric detector having a cooling device and a manufacturing method thereof.

2. Related Background Art

An example of a conventional photoelectric detector with a cooling device is disclosed in Japanese Patent Laid-Open No. 49-106380. The apparatus disclosed in this publication comprises a detector main body in a transparent glass valve. This detector main body is constituted such that photoelectrons are generated from a photoelectric converting unit, i.e., a photoelectric surface in accordance with incident light via the glass valve and a grid, and the photoelectrons are collected by an anode while being multiplied by a plurality of stages of dynodes.

This apparatus further comprises a substrate which has electrically insulating and heat conductive properties and with which the photoelectric converting unit is brought into tight contact. The distal end of this substrate is directly attached to a metal plate disposed on the top portion of the glass valve, and this metal plate is directly fixed to a low-temperature plate at a low temperature side of a Peltier element. A heat sink with a radiation fin is fixed to a high-temperature plate of the Peltier element at a high temperature side having a Peltier effect. The Peltier element comprises the low- and high-temperature plates serving as good heat conductors, and a thermoelectric cooling unit, arranged between these plates, for dissipating heat absorbed by the high-temperature plate from the low-temperature plate, in accordance with an applied voltage. Therefore, since the cooling device continues to effectively cool the photoelectric surface via the substrate, it is difficult to generate thermoelectrons from the photoelectric surface, improving the performance of the photoelectric detector.

SUMMARY OF THE INVENTION

Since the conventional photoelectric detector with the cooling device is constituted in the above manner, the following problems are posed.

That is, the distal end of the substrate having the photoelectric converting unit formed thereon is directly attached to the metal plate disposed on the top portion of the glass valve. This arrangement degrades joining and mounting between the detector main body and the cooling device. Further, this arrangement makes it difficult to assemble the detector main body and the cooling device difficult when this apparatus is to be assembled.

The present invention has been made to solve the above problems, and has as its object to provide a photodetector or photoelectric detector with a cooling device in which a detector main body is reliably joined and mounted to the cooling device, and a method of manufacturing the photoelectric detector with a cooling device in which the assembling operation of a detector main body and the cooling device is facilitated.

An apparatus according to the present invention aims at is a photodetector having a cooler for cooling a photocathode arranged in a tube comprised of a transparent material such that light transmitted through the tube irradiates the photocathode.

This photodetector comprises: (a) a cathode supporting member for supporting the photocathode, the cathode supporting member being arranged in the tube and comprised of a conductive material; and (b) a holding mechanism for biasing the cathode supporting member to supporting the cathode supporting member, the holding mechanism being comprised of a heat conductive material and thermally connected to the cooler.

This photodetector further comprises a lid member for sealing an opening of the tube and fixing the holding mechanism to the tube, the lid member being comprised of a heat conductive material and thermally connecting the cooler to the holding mechanism.

When this photodetector is to be assembled, the cathode holding member can be fixed to the tube only by introducing the cathode holding member into the holding mechanism. In addition, the photocathode fixed to the cathode supporting member can be thermally connected to the cooler.

A method according to the present invention aims at a method of manufacturing this apparatus. This method comprises the steps of: sealing one opening of a glass tube by a heat conductive member; attaching, to a lower surface of the heat conductive member, a pair of gripping members which extend from the heat conductive member to the other opening of the glass tube and oppose each other at a predetermined interval; inserting a cathode supporting member between the gripping members from the other opening of the glass tube to attach the cathode supporting member to the heat conductive member; attaching an electronic cooling element to an upper surface of the heat conductive member; and forming a photocathode on a surface of the cathode supporting member.

When a photodetection tube is to be manufactured using a ceramic member, the method according to the present invention comprises the steps of: sealing one opening of a glass tube by a ceramic member; inserting a cathode supporting member between a pair of opposite gripping members of the ceramic member from the other opening of the glass tube to attach the cathode supporting member to the ceramic member; attaching an electronic cooling element to the ceramic member; and forming a photocathode on a surface of the cathode supporting member.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given byway of illustration only, since various changes and modifications within the spirit and scope of the invention will be apparent to those skilled in the art from this detailed description.

DESCRIPTION OF THE PREFERRED EMBODIMENTS

Figure 1:
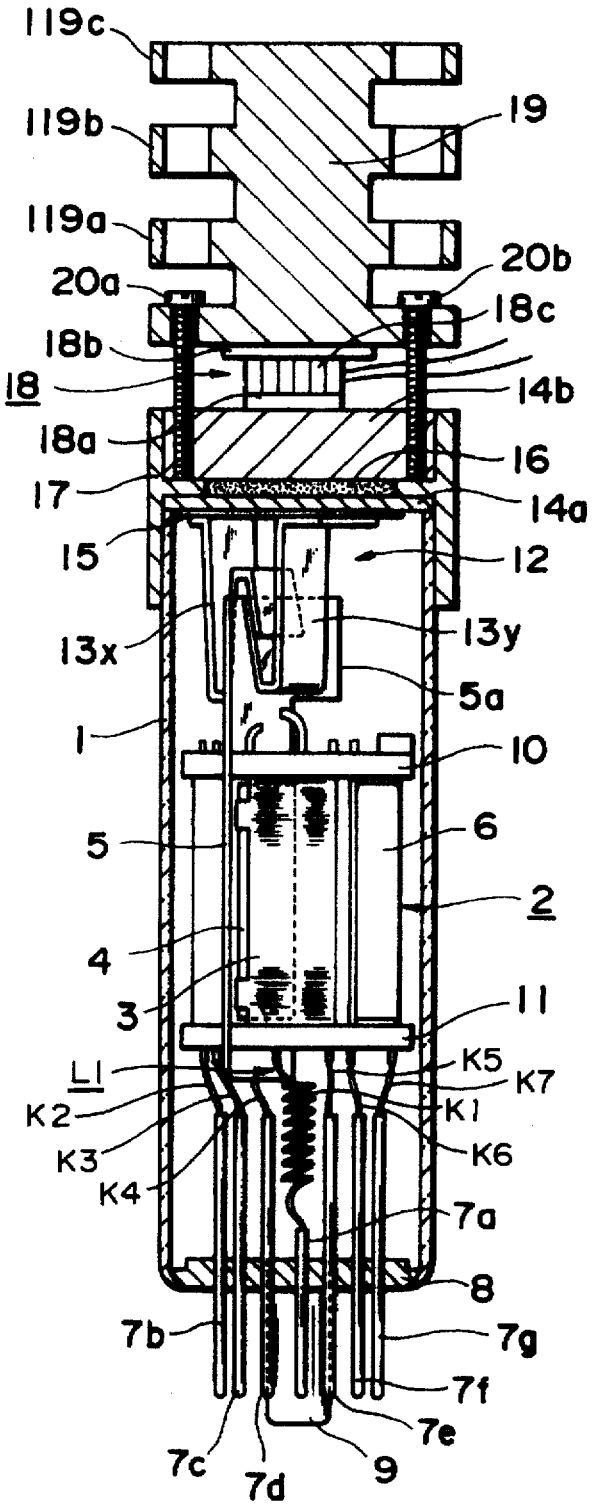
FIG. 1 is a sectional view showing a photoelectric detector with a cooling device according to the present invention.

Preferred embodiments of a photoelectric detector with a cooling device according to the present invention will be described in detail below with reference to the accompanying drawings.

An apparatus (photomultiplier) shown in FIGS. 1 to 6 comprises a tube 1, a lid member 14*a* for sealing an opening AP1 of the tube 1, a gripping mechanism (holding mechanism) 12 attached to the lower surface of the lid member 14*a*, a cathode supporting member 5 gripped by the gripping mechanism 12, a photocathode 4 fixed to the cathode supporting member 5, an anode 30 for collecting electrons generated in the photocathode 4, and an electronic cooling element (cooler) 18 fixed to the upper surface of the lid member 14*a*.

The tube 1 is comprised of a transparent material and has the opening AP1 and an opening AP2. The material of this tube is glass. The lid member 14*a* is comprised of a heat conductive material. The material of the lid member 14*a* is Kovar as an alloy of Fe, Ni, and Co. The gripping mechanism 12 is comprised of a heat conductive material. The gripping mechanism 12 has a pair of gripping members 13*x* and 13*y* for biasing the cathode supporting member 5 sandwiched therebetween. The material of the gripping members 13*x* and 13*y* is CuBe.

The cathode supporting member 5 is comprised of a heat conductive material and arranged in the tube 1. The material of the cathode supporting member 5 is A1. The photocathode 4 emits electrons E1 and E2 in response to light LT1 incident thereon via the tube 1 (see FIG. 2). The anode 30 is arranged in the tube 1. By supplying power to the electronic cooling element 18, a cool portion 18*a* thereof is cooled and a hot portion 18*b* thereof is heated. The electronic cooling element 18 is a Peltier element.

In order to easily and firmly attach a heat sink 19 to the electronic cooling element 18, this apparatus further comprises a fixing member 14*b*, an adhesive member 16, and bolts 20*a* and 20*b*. The fixing member 14*b* is arranged between the lid member 14*a* and the electronic cooling element 18. The fixing member 14*b* is comprised of a material having electrically conductive and heat conductive properties and has fixing holes 14*d* and 14*e*. The material of the fixing member 14*b* is selected from any one of Cu and A1. The adhesive member 16 is interposed between the fixing member 14*b* and the lid member 14*a* and adheres the fixing member 14*b* to the lid member 14*a*. The adhesive member 16 is comprised of a material having electrically insulating and heat conductive properties. The material of the adhesive member 16 is an R bond resin.

The heat sink 19 contacts the hot portion 18*b* of the electronic cooling element 18 and has fixing holes 19*c* and 19*d*. The bolts 20*a* and 20*b* are inserted in the fixing holes 14*d* and 14*e* of the fixing member 14*b* through the fixing holes 19*c* and 19*d* of the heat sink 19. The heat sink 19 is fixed to the electronic cooling element 18 via the bolts 20*a* and 20*b*. The fixing member 14*b* is comprised of a heat conductive material so that heat from the cathode supporting member 5 may efficiently conduct to the electronic cooling element 18. Most of heat conductive materials are highly electrically conductive. If the electrically conductive fixing member 14*b* is brought into contact with the electrically conductive heat sink 19, the cool portion 18*a* and the hot portion 18*b* of the electronic cooling element 18, which respectively contact the fixing member 14*b* and the heat sink 19, are short-circuited. For this reason, the bolts 20*a* and 20*b* are comprised of an electrically insulating material, i.e., plastic.

In order to make this fixed structure more rigid, the present apparatus further comprises a reinforcing member 17. The reinforcing member 17 is interposed between the lid member 14*a* and the fixing member 14*b*. The reinforcing member 17 has an opening AP3, an annular portion 17*a* having the opening AP3 in which the adhesive member 16 is arranged, and a cylindrical portion 17*b*, continuous with the annular portion 17*a*, for covering a predetermined area of an outer surface 1*p* of the tube 1 and a predetermined area of a circumferential surface 14*p* of the fixing member 14*b* to tighten the tube 1 and the fixing member 14*b* (see FIG. 5). The material of the reinforcing member 17 is silicone rubber.

In order to bias the cathode supporting member 5, the gripping members 13*x* and 13*y* are comprised of a highly elastic material. Though the lid member 14*a* is comprised of a material having a high adhesion strength with to the glass tube 1, it is difficult to directly fix the lid member 14*a* to the gripping members 13*x* and 13*y* made of the highly elastic material. For this reason, the holding mechanism 12 further comprises a buffer member 15 interposed between the gripping members 13*x* and 13*y* and the lid member 14*a*. When the material of the lid member 14*a* is an alloy of Fe, Ni, and Co, and the material of the gripping members 13*x* and 13*y* is CuBe, the material of the buffer member 15 is preferably Ni.

A predetermined potential is applied to the cathode supporting member 5 via a first pin 7*a* during the operation of the apparatus. Since the cathode supporting member 5 is cooled, the first pin 7*a* connected to the cathode supporting member 5 is also cooled. When the first pin 7*a* is cooled, dew attaches to the first pin 7*a*. The present apparatus further comprises a wiring cable K1 for connecting the cathode supporting member 5 to the first pin 7*a*. The wiring cable K1 is longer than any one of wiring cables K2 to K7 respectively connected to remaining pins 7*b* to 7*g*. Therefore, dew is prevented from attaching to the first pin 7*a* even if the first pin 7a is cooled. The wiring cable K1 is a coiled wiring cable electrically connected to the cathode supporting member 5. The coiled wiring cable K1 is electrically connected to the first pin 7a.

This apparatus will be described in more detail below.

Figure 2:
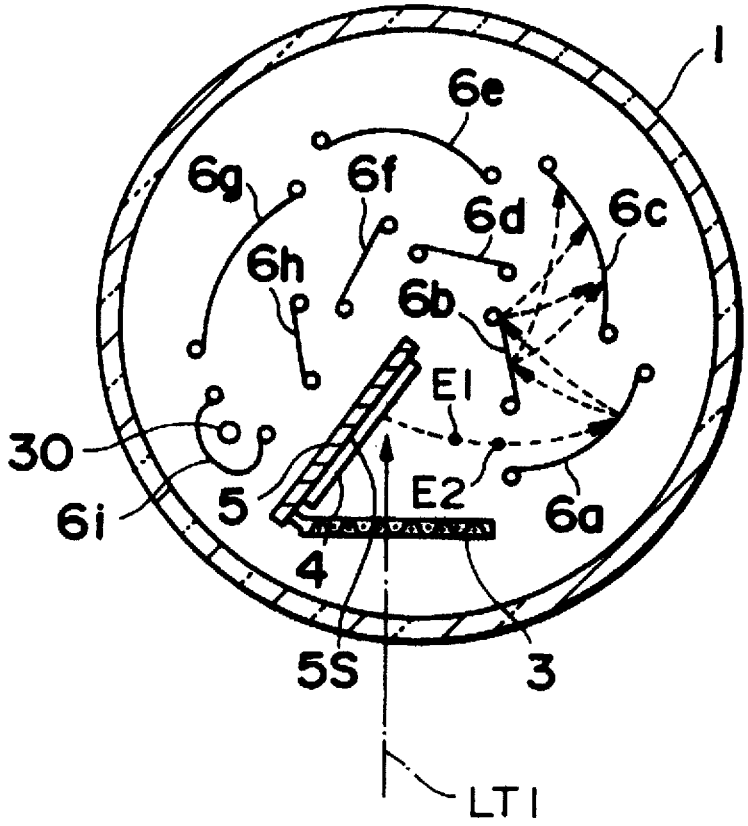
FIG. 2 is a cross-sectional view showing the photoelectric detector with the cooling device according to the present invention.

Referring to FIGS. 1 and 2, a detector main body 2 is arranged in the cylindrical transparent tube or glass valve 1. The detector main body 2 comprises the photoelectric converting unit (photocathode) 4 for generating photoelectrons in accordance with incident light via the glass valve 1 and a grid 3, the cathode supporting member or substrate 5 with good heat conductive and electrically conductive properties which has the photoelectric converting unit 4 on its surface, a plurality of stages of dynodes 6a, 6b, 6c, 6d, 6e, 6f, 6g, 6h, and 6i for sequentially multiplying the photoelectrons emitted from the photoelectric converting unit 4, i.e., the photoelectric surface, and the anode 30 for collecting the multiplied photoelectrons to extract them as an output signal. The detector main body 2 has the first pin 7a for applying a predetermined potential to the grid 3 and the photocathode 4, the pair of pins 7a and 7e for applying a voltage across the photocathode 4 and the first stage dynode 6a, the pair of pins 7e and 7c for applying a voltage across the first stage dynode 6a and the anode 30, and the plurality of pins 7b, 7d, 7f, and 7g for applying a voltage across the remaining dynodes. A high voltage is sequentially applied across these pins. The detector main body 2 further comprises a stem 8 for fixing these pins or pin terminals 7, and a tubular portion 9 extending through the stem 8.

Of the plurality of pin terminals 7a to 7g, the pin terminal 7a coupled to the substrate 5 is set to a very low temperature. For this reason, the wiring cable K1 for preventing dew is provided midway along a connection L1 between the pin terminal 7a and the substrate 5. Note that this embodiment describes the photoelectric converting unit 4 as the photoelectric surface deposited on the substrate 5 serving as a cathode plate. Part or all of the cathode plate having a surface on which the photoelectric surface (photoelectric converting unit) 4 is deposited may be adhered to a shield plate. In this case, a composite of the shield plate and the cathode plate functions as the substrate 5.

Figure 3:
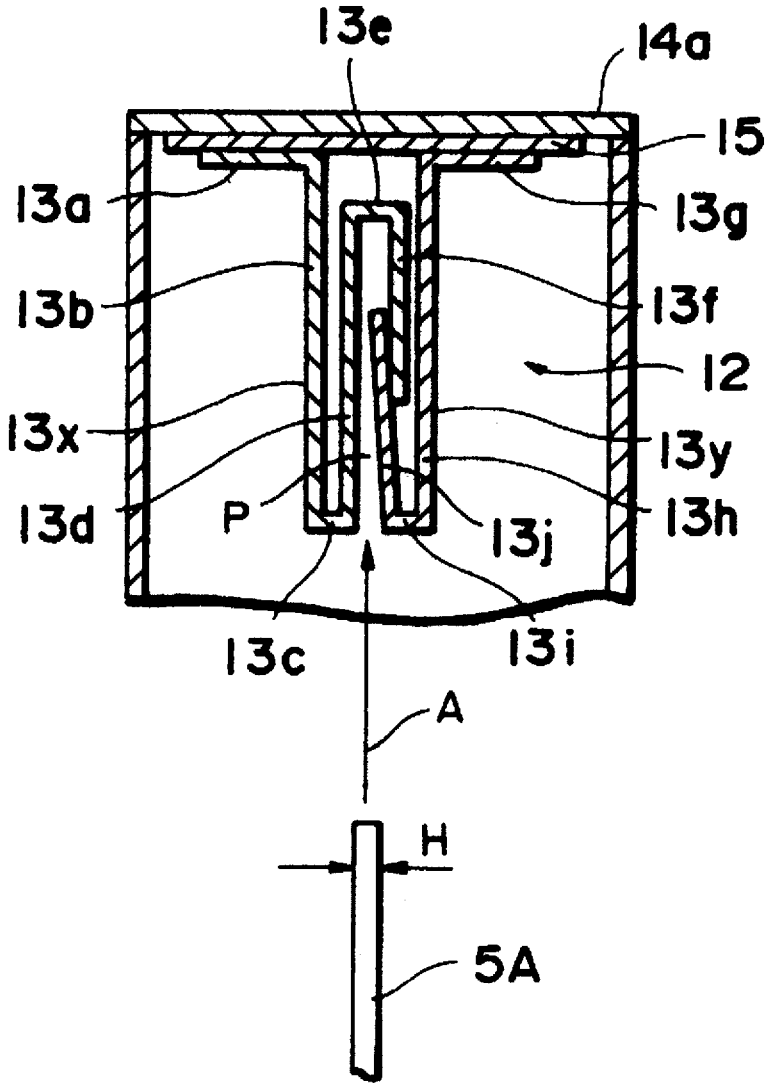
FIG. 3 is an enlarged sectional view showing contact members which constitute the main part of the photoelectric detector according to the present invention.

The substrate 5 projects from first and second insulating substrates 10 and 11, and particularly a projection amount is larger on the first insulating substrate 10 side. The substrate 5 has a wide joining piece 5a at its top portion. The gripping members or contact pieces 13x and 13y of the gripping mechanism or contact member 12 are joined to the joining piece 5a. The contact pieces 13x and 13y are fixed to the lid member or conductive plate 14a which constitutes part of the heat conductor (14a, 16, and 14b), and project toward the substrate 5. As shown in FIGS. 1 and 3, the contact member 12 (holding mechanism, or gripping mechanism) has the contact pieces 13x and 13y each of which is comprised of a CuBe material having spring elasticity and has a plate thickness of about 0.3 mm and a plate width of about 5 mm, and the buffer member or holder plate 15 for fixing the contact pieces 13x and 13y by electronic welding or the like.

The first contact piece 13x comprises a first leg portion 13a fixed to the holder plate 15, a first elastic portion 13b extending from one end of the first leg portion 13a at a right angle, a second elastic portion 13d extending inward from the first elastic portion 13b via a first bent portion 13c having a bending angle of 90°, and a third elastic portion 13f extending inward from the second elastic portion 13d via a second bent portion 13e having a bending angle of 90°. The second contact piece 13y comprises a second leg portion 13g fixed to the holder plate 15, a fourth elastic portion 13h extending from one end of the second leg portion 13g at a right angle, and a fifth elastic portion 13j extending inward from the fourth elastic portion 13h via a third bent portion 13i having a bending angle of 90°.

The free end of the fifth elastic portion 13j is engaged with the free end of the third elastic portion 13f such that these free ends overlap each other. Therefore, an accommodation portion P for accommodating the joining piece 5a of the substrate 5 is constituted by the second elastic portion 13d, the second bent portion 13e, the third elastic portion 13f, and the fifth elastic portion 13j. The center of the accommodation portion P becomes narrower than a plate thickness H of the joining piece 5a due to the overlap of the third elastic portion 13f and the fifth elastic portion 13j. By inserting the joining piece 5a of the substrate 5 into the accommodation portion P from a direction indicated by an arrow A, the accommodation portion P is widened by the joining piece 5a. As a result, the joining piece 5a of the substrate 5 is elastically sandwiched in the accommodation portion P by the cooperation of the first and second contact pieces 13x and 13y to be brought into surface contact with the contact pieces 13x and 13y. Therefore, by the assembling operation of inserting the detector main body 2 in the glass valve 1, the substrate 5 can be coupled to the heat conductor 14 via the contact pieces 13x and 13y at once.

As shown in FIG. 1, the heat conductor 14 is constituted by the lid member or Kovar metal-made conductive plate 14a which is fused to the glass valve 1 by RF heating so as to close the opening end of the glass valve 1, and the fixing member or base 14b which is adhered to the conductive plate 14a via the resin adhesive (preferably R bond; tradename) 16 having good heat conductive and electrically insulating properties and is comprised of a Cu or Al material. The reinforcing member or cylindrical ring 17 made of silicone rubber is attached to the outer surface of the top portion of the glass valve 1 and has a shape to accommodate the heat conductor 14. Therefore, by using the ring 17, dew can be prevented at the top portion of the glass valve 1, and the number of manufacturing steps can be decreased. That is, by using the ring 17, the adhesive 16 can be prevented from flowing out, and positioning of the heat conductor 14 can be assured.

The cool portion or low-temperature plate 18a at a low temperature side of the Peltier element 18 which constitutes part of a cooling device 21 is directly fixed on the base 14b. The heat sink 19 having radiation fins 119a to 119c which constitutes part of the cooling device 21 is fixed to the hot portion or high-temperature plate 18b at the high temperature side of the Peltier element 18. Note that the Peltier element 18 comprises, between the low-temperature plate 18a and the high-temperature plate 18b, a thermoelectric cooling portion 18c for dissipating, by an applied voltage, heat absorbed by the high-temperature plate 18b from the low-temperature plate 18a. The Peltier element 18 is clamped between the base 14b and the heat sink 19 by the pair of bolts or screws 20a and 20b made of a plastic. One end of each of the screws 20a and 20b is fastened in the base 14b, and the other end is fixed to the heat sink 19.

The operation of the photoelectric detector with the cooling device according to the present invention will be described next.

A predetermined potential is applied to the photocathode 4, the dynodes 6a to 6i, and the anode 30 of the detector main body 2 via the pin terminals 7a to 7g. As a result, photoelectrons are generated from the photoelectric converting unit 4, i.e., the photoelectric surface in accordance with incident light. The photoelectrons are sequentially multiplied by the plurality of dynodes 6a to 6i, and the multiplied photoelectrons are collected by the anode 30 as an output signal. Unnecessary thermoelectrons are emitted from the photoelectric converting unit 4, i.e., the photoelectric surface due to heat of the photoelectric surface. The photoelectric converting unit 4 is continuously cooled by the Peltier effect while heat of the photoelectric converting unit 4 is absorbed by the high-temperature plate 18b of the Peltier element 18 from the low-temperature plate 18a via the contact pieces 13x and 13y joined to the substrate 5. Therefore, generation of thermoelectrons from the photoelectric surface 4 can be reduced.

A method of manufacturing the photoelectric detector with the cooling device according to the present invention will be explained below.

This manufacturing method comprises the step of sealing one opening AP1 of the glass tube 1 by the heat conductive member 14a, the step of attaching, to a lower surface 14c of the heat conductive member 14a, the pair of gripping members 13x and 13y which extend from the heat conductive member 14a to the other opening AP2 of the glass tube 1 and oppose each other at a predetermined interval, the step of inserting the cathode supporting member 5 between the gripping members 13x and 13y from the other opening AP2 of the glass tube 1 to attach the cathode supporting member 5 to the heat conductive member 14a, the step of attaching the electronic cooling element 18 to an upper surface 14u of the heat conductive member 14a, and the step of forming the photocathode 4 on a surface 5s of the cathode supporting member 5.

This manufacturing method will be described in more detail hereinafter.

Figure 4:
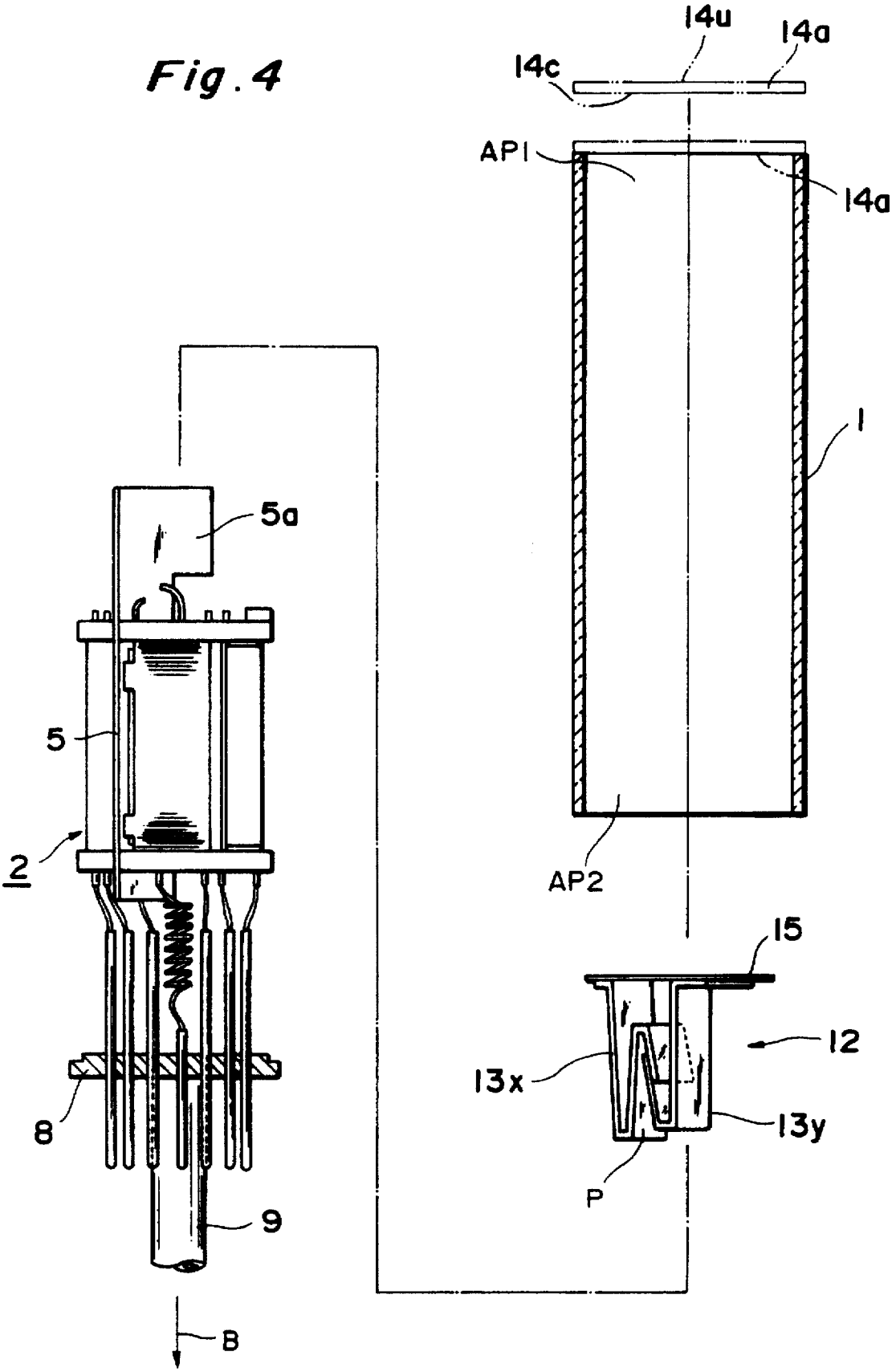
FIG. 4 is a sectional view showing a step of inserting a detector main body and the contact members in a glass valve.

As shown in FIG. 4, first, the conductive plate 14a constituting part of the heat conductor 14 is fused by RF heating to one end of the glass valve 1 whose two ends are open. The holder plate 15 of the contact member 12 is fixed to the lower surface or inner surface 14c of the conductive plate 14a by electronic welding. Then, while the detector main body 2 is inserted from the other end of the glass valve 1, the joining piece 5a of the substrate 5 is pressed into the accommodation portion P of the contact pieces 13. As a result, the joining piece 5a of the substrate 5 is elastically sandwiched in the accommodation portion P by the cooperation of the first contact piece 13x and the second contact piece 13y to surface-contact the contact pieces 13.

Figure 5:
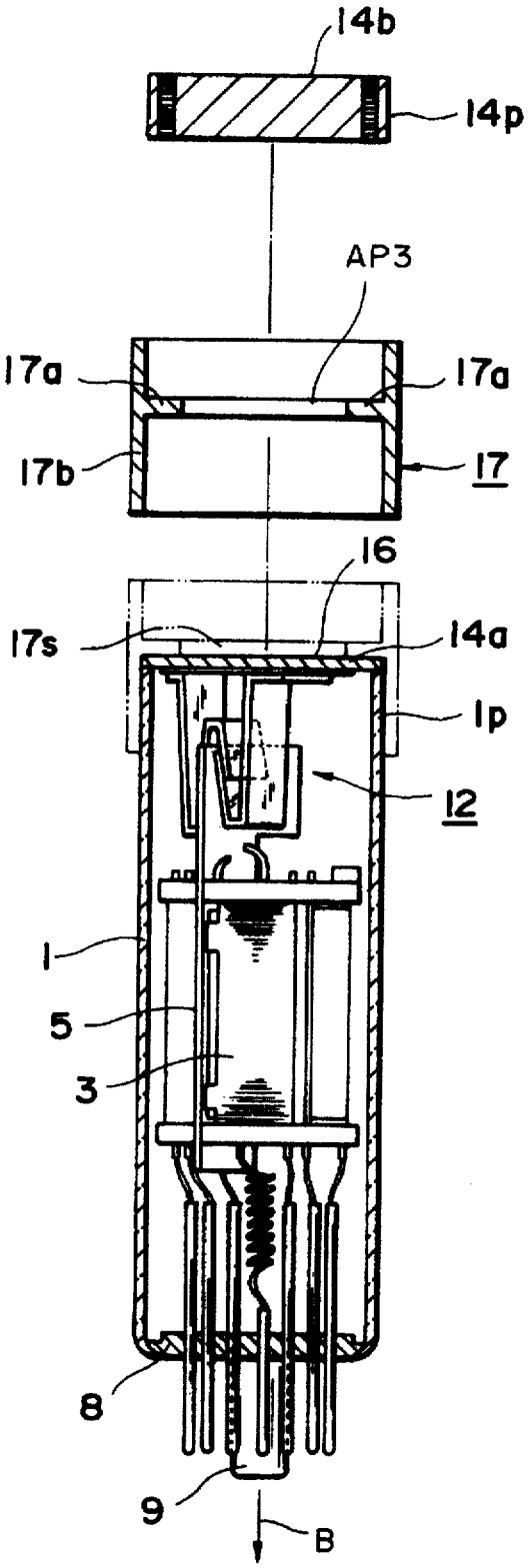
FIG. 5 is a sectional view showing a step of disposing a base constituting part of the detector main body on the end portion of the glass valve.

Thereafter, as shown in FIG. 5, the glass valve 1 and the stem 8 are fused by using an oxygen burner or the like. Thus, the glass valve i is sealed by the conductive plate 14a and the stem 8. The interior of the glass valve 1 is evacuated via the tubular portion 9 in a direction of an arrow B to set the interior of the glass valve 1 at $10^{-8}$ torr. At this time, Sb is deposited on the photoelectric converting unit 4 and the dynodes 6 in advance. By supplying at least one of Na, K, Cs, and Rb in an appropriate Mount via the tubular portion 9, an alkali is activated in the glass valve 1. Then, the end portion of the tubular portion 9 is closed to completely seal the glass valve 1.

The ring 17 made of silicone rubber is fitted in the glass valve i to bring the annular portion or pawl portion 17a of the ring 17 into contact with the conductive plate 14a. The resin adhesive (preferably R bond; tradename) 16 having good heat conductive and electrically insulating properties is poured into a space 17s formed by the pawl portion 17a and the conductive plate 14a. The base 14b is inserted in the ring 17 from the upper portion to fix the base 14b to the conductive plate 14a via the adhesive 16 and the pawl portion 17a. The assembling operation of the heat conductor 14 is finished. Note that the base 14b must be tightly pressed so as not to form a gap between the adhesive 16 and the base 14b. Upon completion of the assembling operation of the heat conductor 14, if the heat conductor 14 is kept still for a predetermined period of time (e.g., all night), the adhesive 16 solidifies to firmly fix the base 14b to the conductive plate 14a.

Figure 6:
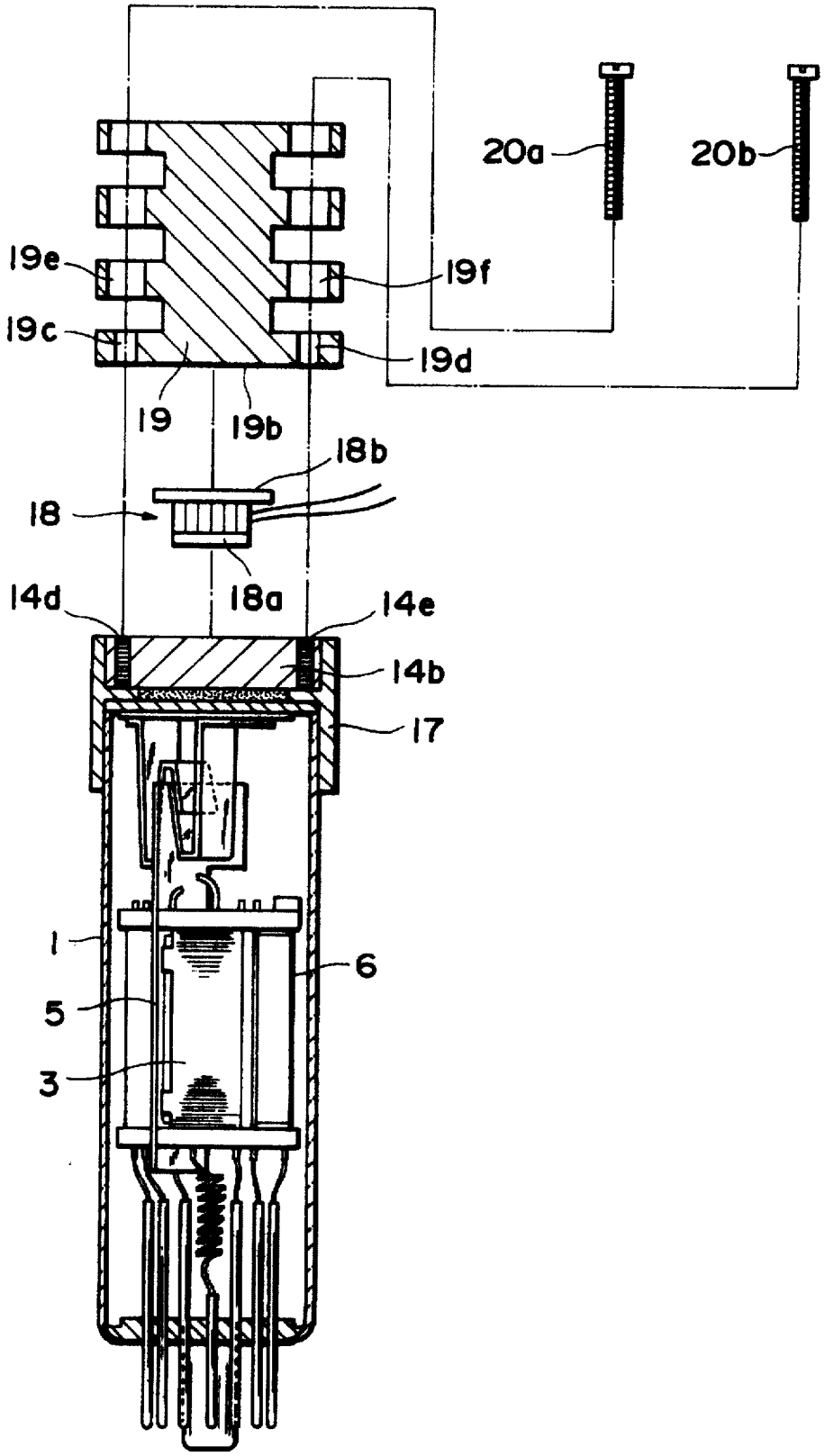
FIG. 6 is a sectional view showing a step of fixing the cooling device on the base.

As shown in FIG. 6, the low-temperature plate 18a of the Peltier element 18 is brought into contact with the base 14b, and an end face 19b of the heat sink 19 is brought into contact with the high-temperature plate 18b of the Peltier element 18. The two screws 20 are threadably engaged with the fixing holes or male thread portions 14d and 14e of the base 14b by inserting the screws 20 into the fixing holes or through holes 19c and 19d. As a result, the cooling device 21 is properly positioned with respect to the heat conductor 14.

The photoelectric detector of the present invention is not limited to the above embodiment.

Figure 7:
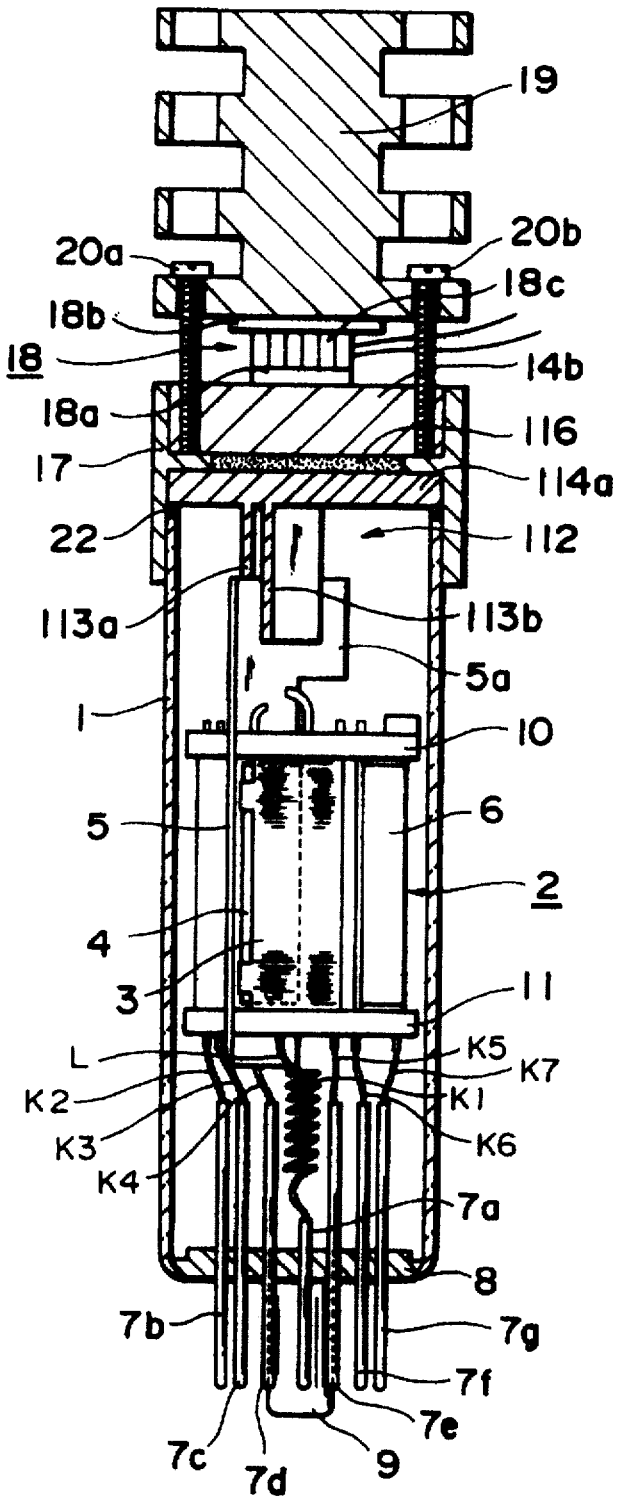
FIG. 7 is a sectional view of an apparatus according to the second embodiment.
Figure 8:
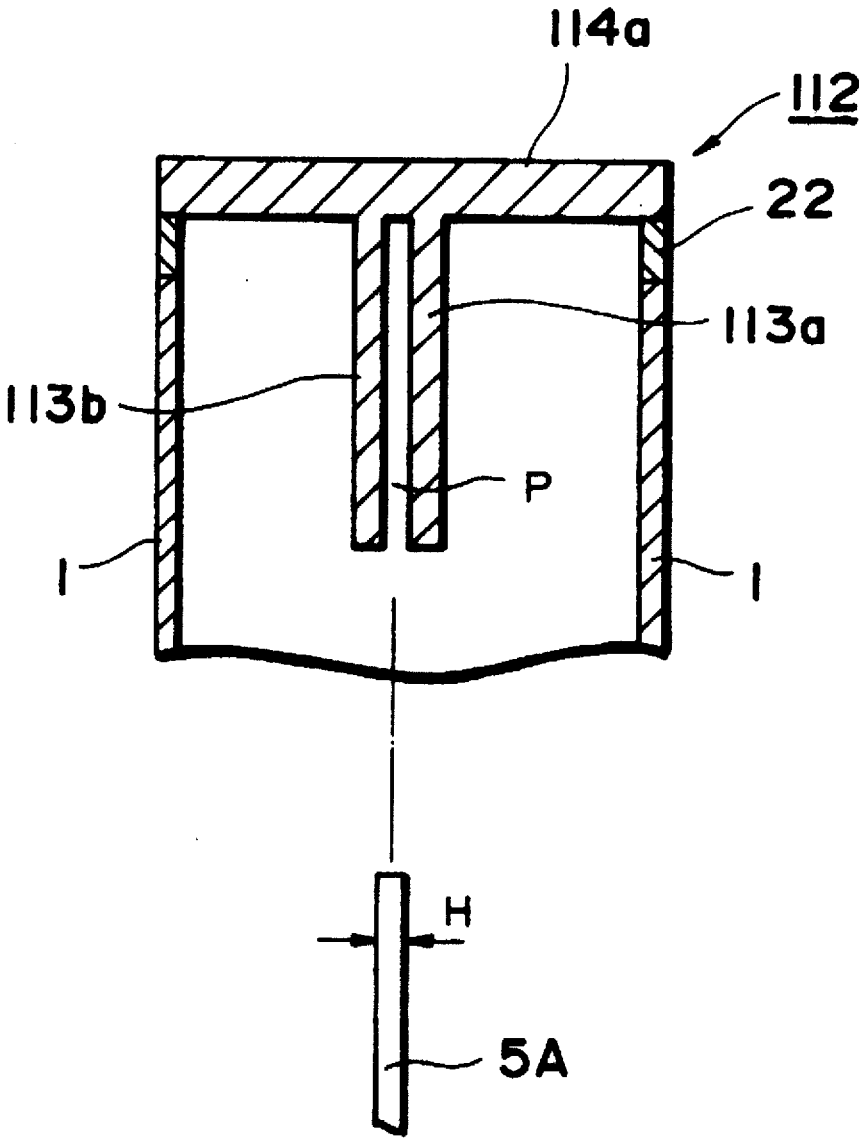
FIG. 8 is a sectional view of the main portion of the apparatus shown in FIG. 7.

As shown in FIGS. 7 and 8, a cathode supporting member 5 may be sandwiched by a ceramic member 112. That is, an apparatus shown in FIGS. 7 and 8 comprises a tube 1, the ceramic member 112, the cathode supporting member 5, a photocathode 4, an anode shown in FIG. 2, a metal seal member 22, and an electronic cooling element 18. Note that the same reference numerals as in FIG. 1 denote the same parts in the apparatus shown in FIGS. 7 and 8.

The ceramic member 112 comprises a lid portion or member 114a for sealing the opening of the tube 1, and a pair of gripping portions 113a and 113b, continuous with the lid portion 114a, for sandwiching the cathode supporting member 5 therebetween. Since the cathode supporting member 5 and the ceramic member 112 are comprised of heat conductive materials, the photocathode 4 fixed to the cathode supporting member 5 is cooled by the electronic cooling element 18 via the cathode supporting member 5, the ceramic member 112, an adhesive member 116, and a fixing member 14b. Since a ceramic is an electrical insulator, the adhesive member 116 need not be an electrical insulator.

Electrons emitted from the cooled photocathode 4 are collected by an anode 30 arranged in the tube, as shown in FIG. 2. The metal seal member 22 is interposed between the ceramic member 112 and the tube 1. The metal seal member 22 is comprised of an alloy of Fe, Ni, and Co.

This apparatus will be described in more detail.

The lid portion 114a and the gripping portions 113a and 113b are integrally formed of a ceramic. The ceramic member or gripping mechanism 112 comprises the two gripping portions or first and second linear contact pieces 113a and 113b which are disposed parallel to each other. When a joining piece 5a is not inserted between the gripping portions 113a and 113b, the ceramic member 112 has an accommodation space P having a width slightly smaller than a plate thickness H of the joining piece 5a. Therefore, when the joining piece or one end portion 5a of the cathode supporting member is inserted between the gripping portions 113a and 113b, the gripping portions 113a and 113b bias and hold the joining piece 5a sandwiched therebetween.

By the operation of fixing a heat conductor 14 to one end of the tube or glass valve 1, the contact pieces 113a and 113b can be easily positioned in the glass valve 1. The joining piece 5a can be elastically clamped between the first and second contact pieces 113a and 113b. The ceramic member or ceramic heat conductor 112 and the glass valve 1 are fixed to each other via the appropriate metal member 22 to firmly join them. The effect of integrally forming the lid member 114*a* and the contact pieces 113*a* and 113*b* by using a ceramic is as follows: an electrically insulating member need not be provided between the electronic cooling element or Peltier element 18 and the lid member 114*a* because a ceramic itself has an electrically insulating property, thereby improving the heat conductivity.

A method of manufacturing this photoelectric detecting tube comprises the step of sealing one opening AP of the glass tube 1 by the ceramic member 112, the step of inserting the cathode supporting member 5 between the pair of opposite gripping members 13*a* and 113*b* of the ceramic member 112 from the other opening of the glass tube 1 to attach the cathode supporting member 5 to the ceramic member 112, the step of attaching the electronic cooling element 18 to the ceramic member 112, and the step of forming the photocathode 4 on the surface of the cathode supporting member 5.

Figure 9:
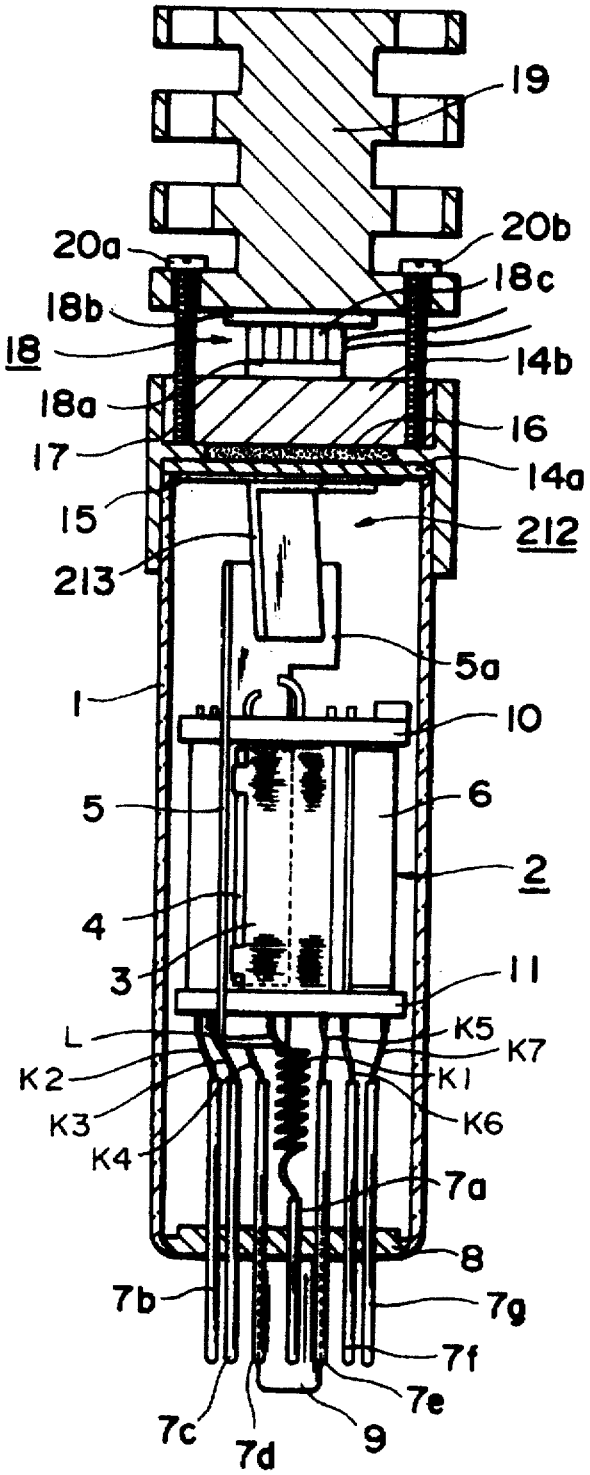
FIG. 9 is a sectional view of an apparatus according to the third embodiment.
Figure 10:
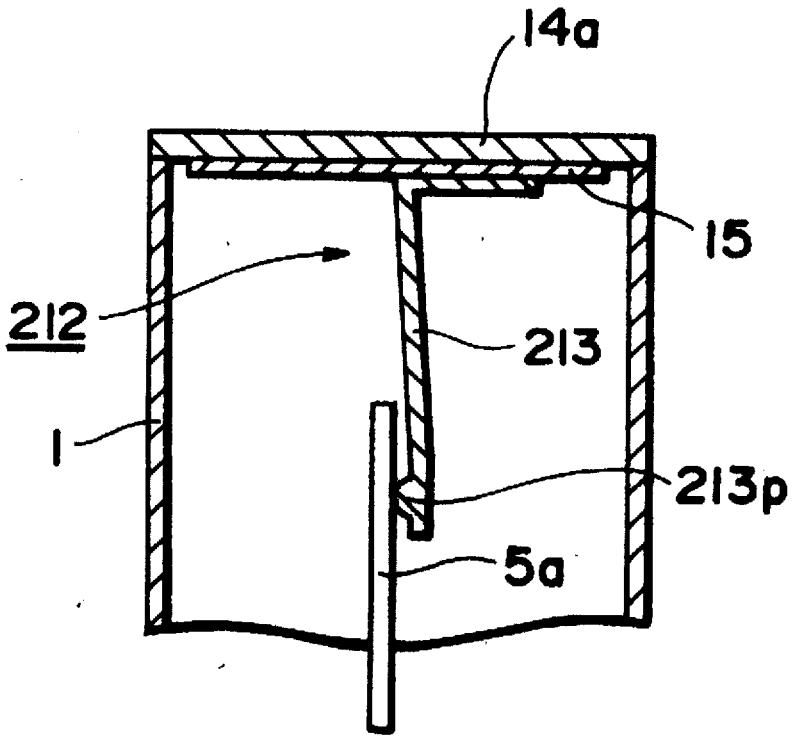
FIG. 10 is a sectional view of the main portion of the apparatus shown in FIG. 9.

According to still another embodiment, as shown in FIGS. 9 and 10, an apparatus can be constituted such that one elastic contact piece 213 biases a joining piece 5*a* without employing the above-mentioned arrangement in which the contact pieces 113*a* and 113*b* clamp the joining piece 5*a*. As a result, the arrangement of the contact piece 213 can be greatly simplified to decrease the manufacturing cost. That is, a holding mechanism 212 comprises the contact piece or biasing member 213 bent at an acute angle, and a buffer member 15 to which one end of the biasing member 213 is fixed. The biasing member 213 biases one end portion 5*a* of a cathode supporting member 5 while a projecting portion 213*p* of the contact piece 213 contacts one end portion 5*a*. The same reference numerals as in FIG. 1 denote the same parts in the apparatus shown in FIGS. 9 and 10.

Figure 11:
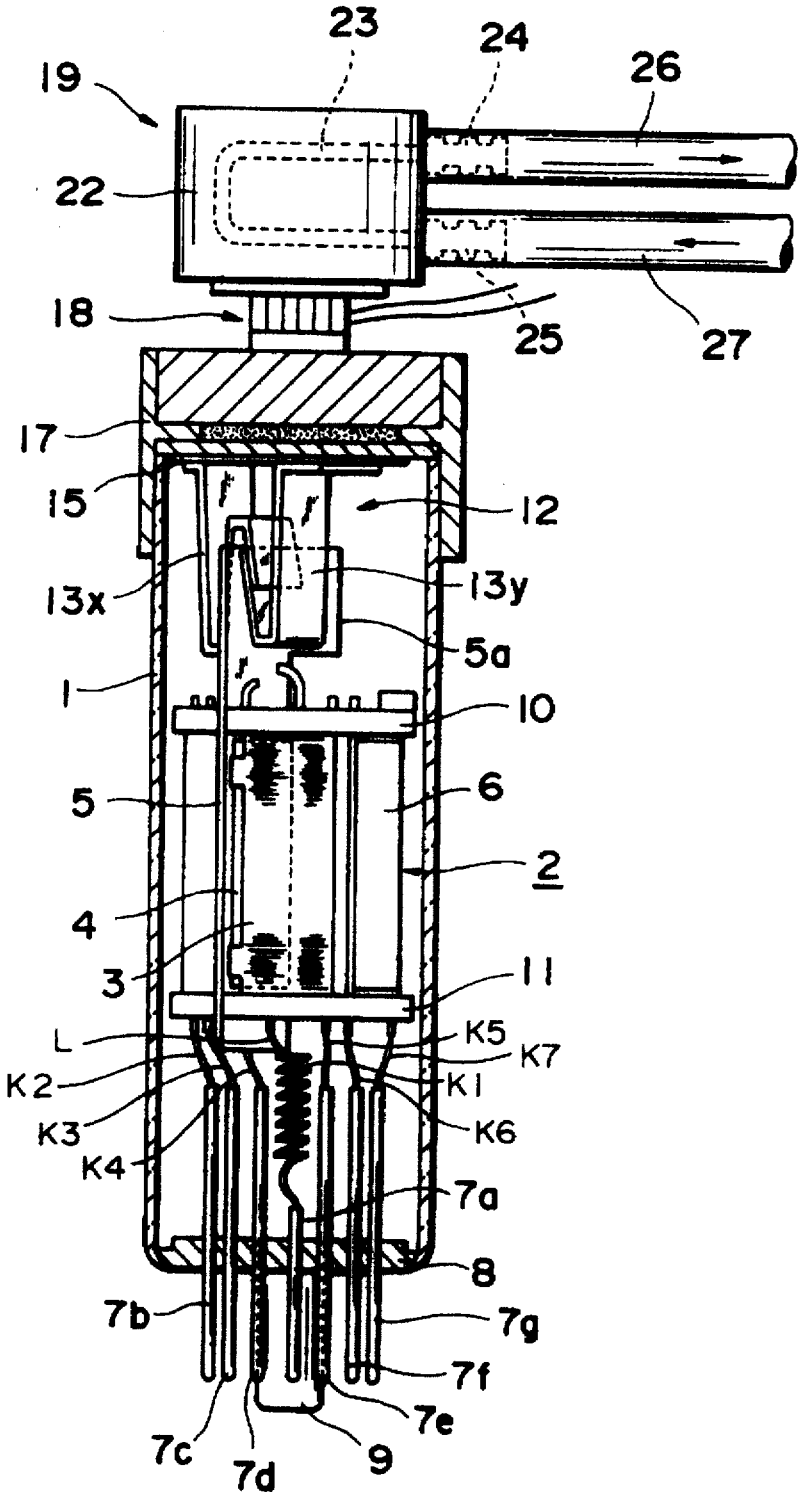
FIG. 11 is a sectional view of an apparatus according to the fourth embodiment.
Figure 12:
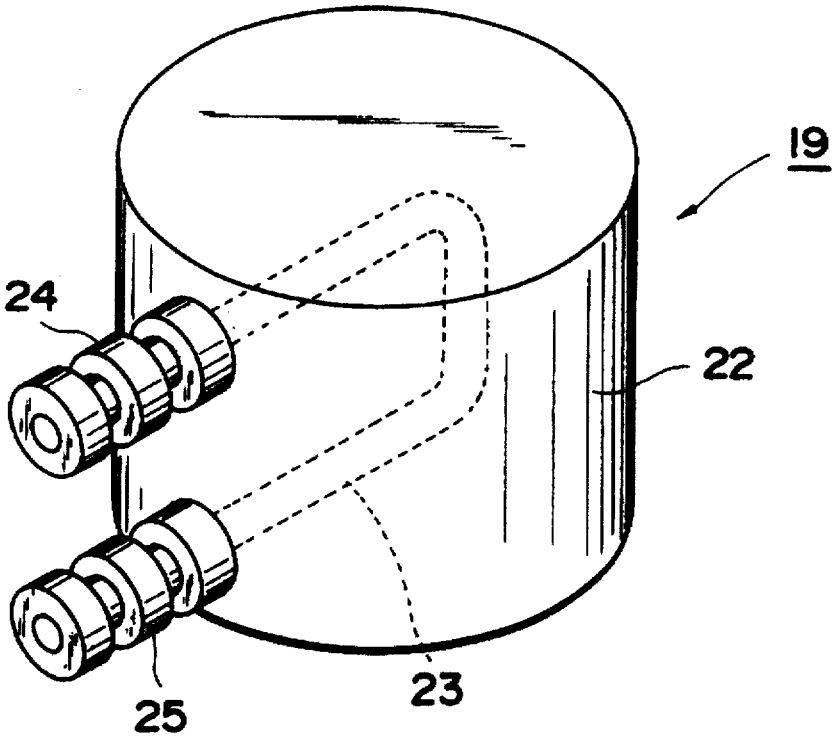
FIG. 12 is a view showing a heat sink of the apparatus in FIG. 11.
Figure 13:
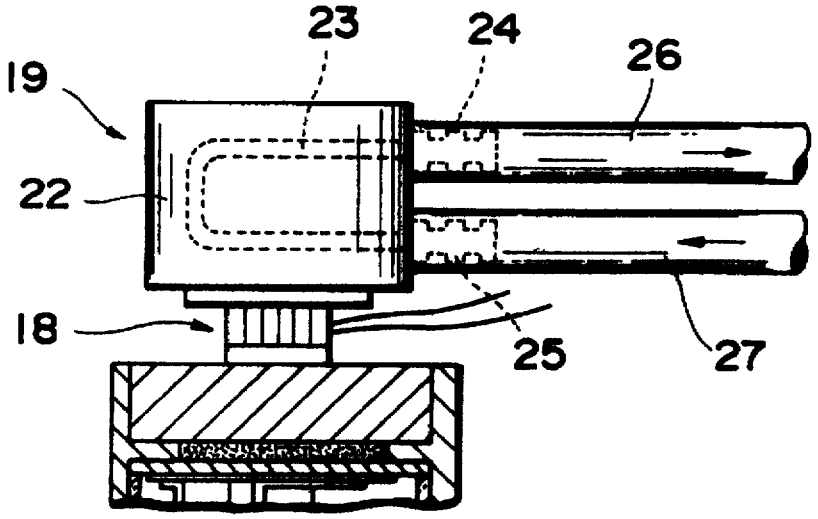
FIG. 13 is a view showing the main portion of the apparatus in FIG. 11.

Further, as shown in FIGS. 11 to 13, a heat sink 19 may be of a water cooling type. For example, the heat sink 19 may be constituted such that a flow path 23 is formed in a solid heat sink main body 22 with good heat conductive properties, which has a cylindrical or rectangular parallelepiped shape, and mouthpiece portions 24 and 25 are respectively formed at the outlet and inlet sides of the flow path 23. These mouthpiece portions 24 and 25 are coupled to a pump (not shown) as a fluid generating source for feeding a stream of 200 to 300 cc/min. Therefore, by employing the water cooling type heat sink 19, the Peltier effect of a Peltier element 18 can be maximized. Note that the same reference numerals as in FIG. 1 denote the same parts in the apparatus shown in FIGS. 11 to 13.

Figure 14:
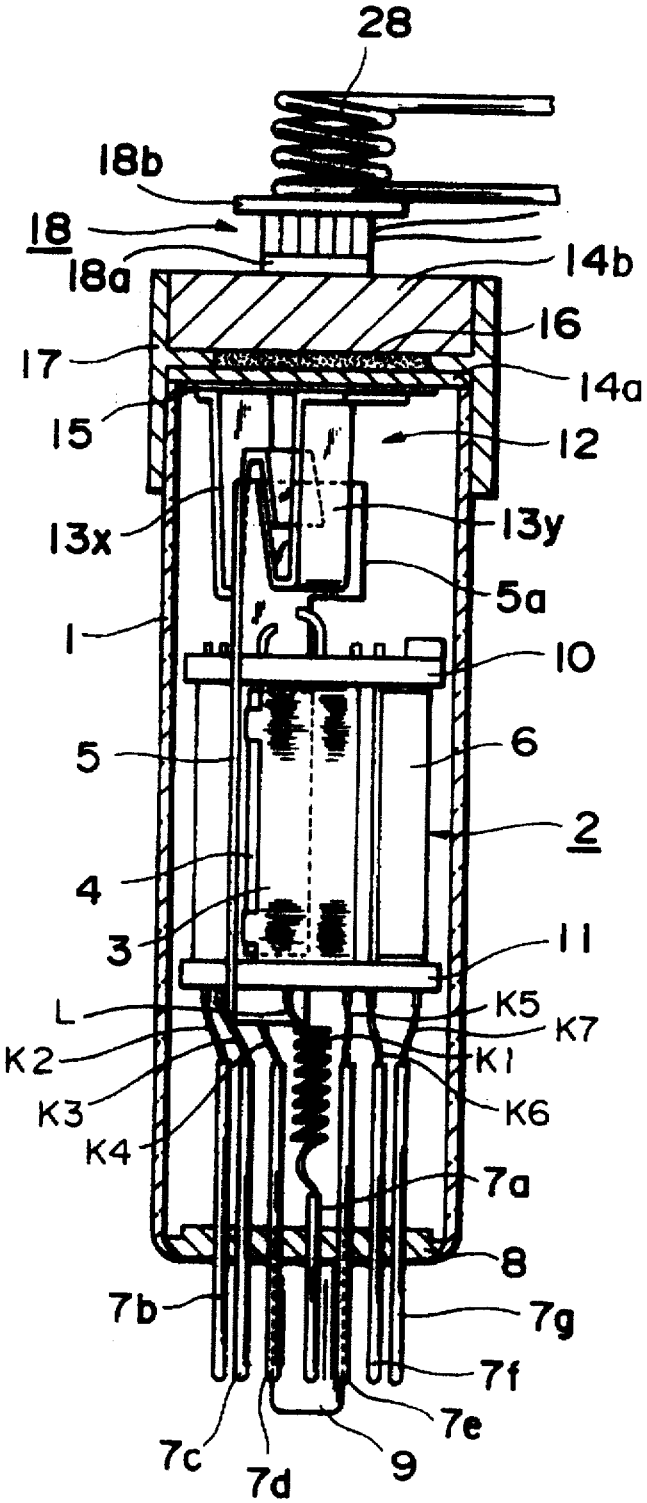
FIG. 14 is a sectional view of an apparatus according to the fifth embodiment.
Figure 15:
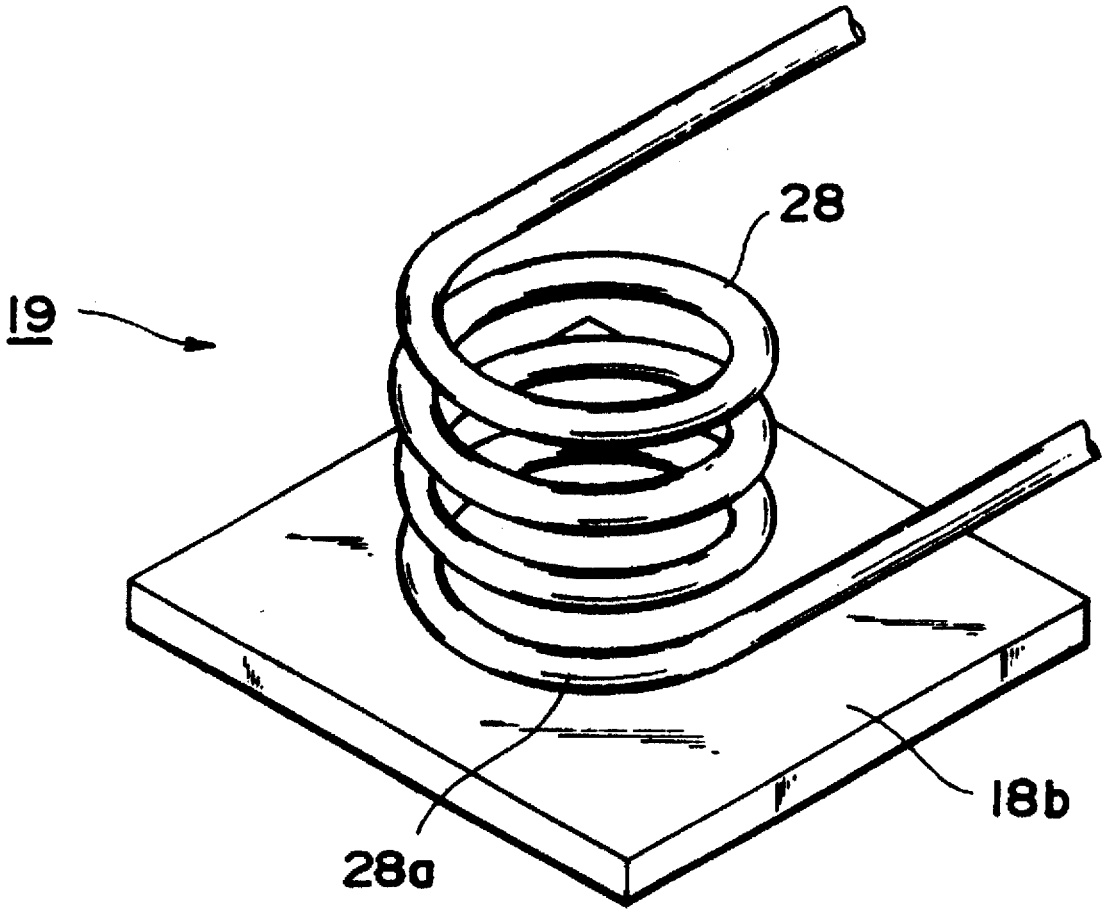
FIG. 15 is a view showing the main portion of the apparatus in FIG. 14.

According to still another embodiment using a water cooling type heat sink, as shown in FIGS. 14 and 15, a tubular portion-shaped heat sink main body 28 having good heat conductive properties may be constituted spirally, and an end face 28*a* of the heat sink main body 28 may contact a high-temperature plate 18*b* of a Peltier element 18 to be fixed thereto. Note that the same reference numerals as in FIG. 1 denote the same parts in the apparatus shown in FIGS. 14 and 15.

A photoelectric detector with a cooling device and a manufacturing method thereof according to the present invention are constituted as described above. Therefore, the following effects can be obtained.

More specifically, by joining the heat conductor to the substrate of the detector main body via the contact pieces, the detector main body can be reliably joined and mounted to the cooling device. In addition, the assembling operation of the detector main body and the cooling device can be facilitated.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

The basic Japanese Application No. 6-148200 (148200/1994) filed on Jun. 29, 1994 is hereby incorporated by reference.

What is claimed is:

1. A photodetector comprising:

a glass tube having an opening;

a photocathode arranged in said tube;

a metal lid member sealing the opening thermally connected to said photocathode;

a cooler thermally connected to said metal lid member;

a fixing member which is arranged between said lid member and said cooler and which comprises an electrically conductive and heat conductive material, and has a fixing hole therein;

an adhesive member, interposed between said fixing member and said lid member, for adhering said fixing member to said lid member, said adhesive member comprising an electrically insulating and heat conductive material;

a heat sink which contacts said cooler and has a fixing hole therein;

a bolt which is inserted in the fixing hole of said fixing member through the fixing hole of said heat sink said heat sink and said fixing member being fixed to each other by said bolt via said cooler;

a reinforcing member interposed between said lid member and said fixing member, said reinforcing member having an annular portion which defines an opening in which said adhesive member is arranged; and a cylindrical portion continuous with said annular portion and covering an outer surface of said tube and a circumferential surface of said fixing member to tighten said tube and said fixing member.

2. A photodetector comprising:

a glass tube having an opening;

a photocathode arranged in said tube;

a metal lid member sealing the opening, thermally connected to said photocathode;

a cooler thermally connected to said metal lid member;

a metal cathode supporting member on which the photocathode is fixed;

a metal holding mechanism arranged in said tube, fixed to said metal lid member, for gripping said cathode supporting member;

wherein said metal holding mechanism has a pair of metal gripping members for gripping said cathode support member, and said metal holding mechanism comprises a buffer member of Ni, interposed between said gripping members and said lid member, a material of said lid member is an alloy of Fe, Ni, and Co, and a material of said gripping members is CuBe.

* * * * *